US006484737B1

(12) United States Patent
Müller et al.

(10) Patent No.: US 6,484,737 B1
(45) Date of Patent: Nov. 26, 2002

(54) PROCESS OF AND DEVICE FOR TREATING SMALL PARTS WITH A LIQUID TREATMENT MEDIUM

(75) Inventors: Alois Müller, Hennef-Happerschoss (DE); Rainer Schön, Balzers (LI)

(73) Assignee: WMV Apparatebau GmbH & Co. KG (DE)

( * ) Notice: Subject to any disclaimer, the term of this patent is extended or adjusted under 35 U.S.C. 154(b) by 91 days.

(21) Appl. No.: 09/611,743

(22) Filed: Jul. 7, 2000

(30) Foreign Application Priority Data

Jul. 8, 1999 (DE) ..... 199 31 663

(51) Int. Cl.[7] ..... B08B 3/04

(52) U.S. Cl. ..... 134/119; 134/102.3; 134/140; 134/186; 134/188; 134/200

(58) Field of Search ..... 134/119, 120, 134/102.3, 95.2, 140, 147, 153, 155, 159, 186, 188, 200; 366/219, 220, 221, 222, 223, 224, 225, 226, 227, 228, 229, 230, 231, 232, 233, 234, 235, 236, 237, 238, 239, 240; 68/210

(56) References Cited

U.S. PATENT DOCUMENTS

| | | | | |
|---|---|---|---|---|
| 1,224,963 | A | * | 5/1917 | Sauer |
| 1,275,515 | A | * | 8/1918 | Woodrow |
| 1,397,652 | A | * | 11/1921 | Pierce |
| 1,754,510 | A | * | 4/1930 | Grenberg |
| 1,809,736 | A | * | 6/1931 | Speidel |
| 1,847,665 | A | * | 3/1932 | Perkins et al. |
| 1,886,201 | A | * | 11/1932 | Lange |
| 2,176,298 | A | * | 10/1939 | Dillon |
| 2,212,560 | A | * | 8/1940 | Foley |
| 2,255,028 | A | * | 9/1941 | Long |
| 2,330,605 | A | * | 9/1943 | Meyer |
| 2,353,637 | A | * | 7/1944 | Batnes |
| 2,391,634 | A | * | 12/1945 | Lewis et al. |
| 2,504,726 | A | * | 4/1950 | Philippi |
| 2,583,823 | A | * | 1/1952 | Dunham |
| 2,782,622 | A | * | 2/1957 | Candor |
| 2,816,429 | A | * | 2/1957 | Kurlancheek |
| 3,164,378 | A | * | 1/1965 | Hager |
| 3,173,664 | A | * | 3/1965 | Isaacson et al. |
| 3,601,088 | A | * | 8/1971 | Lacam |
| 3,744,402 | A | * | 7/1973 | Piegza et al. |
| 4,165,994 | A | * | 8/1979 | Jackson |
| 5,090,220 | A | * | 2/1992 | Fukuzawa et al. |
| 5,111,673 | A | * | 5/1992 | Kadoya et al. |
| 5,442,937 | A | * | 8/1995 | Kwon |
| 6,253,586 | B1 | * | 7/2001 | Lai |

FOREIGN PATENT DOCUMENTS

| | | | |
|---|---|---|---|
| DE | 2940092 | * | 4/1981 |
| FR | 2591242 | * | 6/1987 |
| JP | 2-249591 | * | 10/1990 |
| JP | 5-123480 | * | 5/1993 |
| JP | 5-123486 | * | 5/1993 |
| JP | 6-285441 | * | 10/1994 |
| JP | 10-151566 | * | 6/1998 |
| JP | 10-309547 | * | 11/1998 |

* cited by examiner

*Primary Examiner*—Frankie L. Stinson
(74) *Attorney, Agent, or Firm*—Harness, Dickey & Pierce, P.L.C.

(57) ABSTRACT

A machine for carrying out a process of treating small parts with a liquid treatment medium, especially for coating the small parts or for chemically deburring the small parts, has a closable container which includes a drum to receive the parts. The drum is rotatingly drivable and adjustable between an inclined axis position and a vertical axis position. The process includes filling the drum with small parts and evacuating the closed container. Filling the container with a treatment medium, with the internal pressure set to a value in excess of the steam pressure of the most liquid component of the treatment medium. Inclining the drum to its inclined axis position and rotatingly driving the drum at a low speed. Ventilating the container and setting the drum to its vertical position.

6 Claims, 2 Drawing Sheets

PROCESS OF AND DEVICE FOR TREATING SMALL PARTS WITH A LIQUID TREATMENT MEDIUM

CROSS-REFERENCE TO RELATED APPLICATION

This application is based upon and claims priority to German Patent Application 199 31 663.5 filed Jul. 8, 1999, which application is herein expressly incorporated by reference.

BACKGROUND OF THE INVENTION

The invention relates to a process and device for treating small parts with a liquid treatment medium, especially for coating small parts or for chemically deburring the small parts, in a treatment machine. The machine comprises a closable container which includes a drum to receive the parts. The drum is rotatingly drivable and adjustable between an inclined axis position and a vertical axis position.

Processes and machines have been developed and produced by the Applicant for some time. Examples are found in the following patents: DE 31 21 397 C1, DE 32 30 108 C2, DE 34 20 859 C2 and DE 42 02 880 C1. In each of these cases, the perforated drum that receives the small parts is designed to be releasable from its driving means in the machine. Thus, the drum can be filled and emptied outside the machine. In consequence, the drum, together with the small parts, can be inserted into different machines with identical driving means. The machines serve to carry out different treatment stages. The different treatment stages are carried out in the different machines. The small parts are frequently oiled during mechanical production and then subjected to de-oiling and washing processes as well as to surface treatment processes. It is also possible for chemical deburring to take place between the processes.

With these treatment stages, small parts with cavities that are open on only one side often suffer from air inclusion in the cavities. As a result of inadequate cleaning and/or inadequate coating, this leads to defective regions on the parts. Eventually, this turns the small parts into rejects, for either purely visual reasons or because of a reduced functional ability. If these cavities are particularly small, even agitating the small parts in the drum driven in an inclined position cannot reliably eliminate the air inclusions.

SUMMARY OF THE INVENTION

It is an object of the present invention to provide an improved process and a machine to carry out the process which improves the quality of the treated small parts.

The inventive sequence of process stages includes: Filling the drum with small parts and evacuating the closed container; filling the container with a treatment medium, while the internal pressure is set to a value in excess of the steam pressure of the most volatile component of the treatment medium; inclining the axis position of the drum and rotatingly driving the drum at a low speed; and ventilating the container and setting the drum to the vertical position.

Depending on the process to be carried out, the treatment medium is a coating medium for surface coating or it is an etching fluid for chemical deburring.

By evacuating the container down to a very low internal pressure, for example, in the range of 20 millibar, even the cavities in the small parts are evacuated. Thus, any defect-causing air pockets cannot occur in the cavities when, subsequently, the treatment fluid is introduced into the container. The internal pressure is reduced to the lowest possible level feasible at technically acceptable efforts.

On the other hand, by setting the internal pressure to a higher vacuum level, for example, in the range of 40 millibar, the treatment fluid is prevented from boiling. This is due to the fact that 40 millibar is just in excess of the steam pressure of the most volatile component of the treatment fluid boiling at the lowest temperature. Thus, this prevents the occurrence of a new source of defects and ensures an effective treatment with a treatment fluid which is free from vapor bubbles. A higher vacuum level in the container, for treatment purposes, is partially set automatically by introducing the liquid volume. Renewed evacuation may possibly have to take place for pressure setting purposes.

The drum is rotatingly driven in the inclined axis position for a longer period of time. Next, the container is ventilated and the drum is moved into the vertical position. Accordingly, the defect-free coated parts can be lifted together with the drum from the machine. However, according to a preferred embodiment, first the treatment fluid is pumped off. The drum, in the vertical axis position, is then rotated at an increased speed in order to centrifuge the treatment fluid off the parts as far as possible. This prevents the treatment fluid from being carried over before the subsequent process stages are carried out in the same machine or in a different machine. The treatment process is preferably repeated several times before the drum with the small parts is finally removed from the machine. During the subsequent centrifuging operation, hot air can be blown into the container or the container can again be evacuated. This time it is evacuated down to an internal pressure which is lower than the steam pressure of the treatment fluid. This enables the small parts to dry as quickly as possible.

To complement the above process, it can be preceded by process stages of washing and rinsing the small parts in the same machine. The individual stages can fully correspond to the inventive process stages. A suitable washing or rinsing liquid is used in each case. In particular, in this case, too, it is proposed to evacuate the container prior to introducing the fluid to eliminate air inclusions. Also, the vacuum is set to a level which is in excess of the steam pressure in order to avoid the formation of vapor bubbles. In the same way that the treatment process is improved by the above measures, likewise the preceding washing and rinsing processes are also improved. Here, complete and defect-free moistening of the surfaces of the small parts including their cavities is ensured.

An inventive machine to carry out the above process has a container with a drum arranged in the container. The drum is adjustably rotatingly drivable between a vertical axis position and an inclined axis position. The drum is drivable at at least one lower speed in the inclined axis position and at at least one higher speed in the vertical axis position. An airtight closure of the container is also possible. A mechanism to evacuate the container is included. Further, the machine includes a mechanism to introduce a liquid treatment medium when the container is in a closed and evacuated condition. A mechanism to pump off the liquid treatment medium from the container and a mechanism to control the internal pressure in the container are part of the machine.

The container is connected by pipelines to one or several tanks of the proposed treatment fluids. The tanks contain pumps and shut-offs. Furthermore, the container is connected, via suitable pipelines, to at least one vacuum pump. The exit of the vacuum pump, if necessary, is connected to a mechanism to condense and return pumped off vapors to the tank/tanks.

According to further embodiments, the container includes a hot air ventilator connected to the container interior. Also, it may include at least one ultrasound generator arranged in the container interior.

According to another embodiment, the drum, in an axial sectional view, can be ω-shaped (similar to a ring-shaped cake tin opening towards the top) and include a perforated surface.

To reduce the amount of treatment fluid to be introduced, the container can directly and co-axially enclose the drum. Together with the drum, the container can be adjusted from an inclined axis position into a vertical axis position. An advantage of this design is that the required adjusting device can be arranged in uncomplicated surroundings outside the container and is thus easily accessible.

From the following detailed description, taken in conjunction with the drawings and subjoined claims, other objects and advantages of the present invention will become apparent to those skilled in the art.

BRIEF DESCRIPTION OF THE DRAWINGS

A preferred embodiment of an inventive machine will be described below with reference to the drawings wherein.

DETAILED DESCRIPTION OF THE PREFERRED EMBODIMENT

Figure 1:
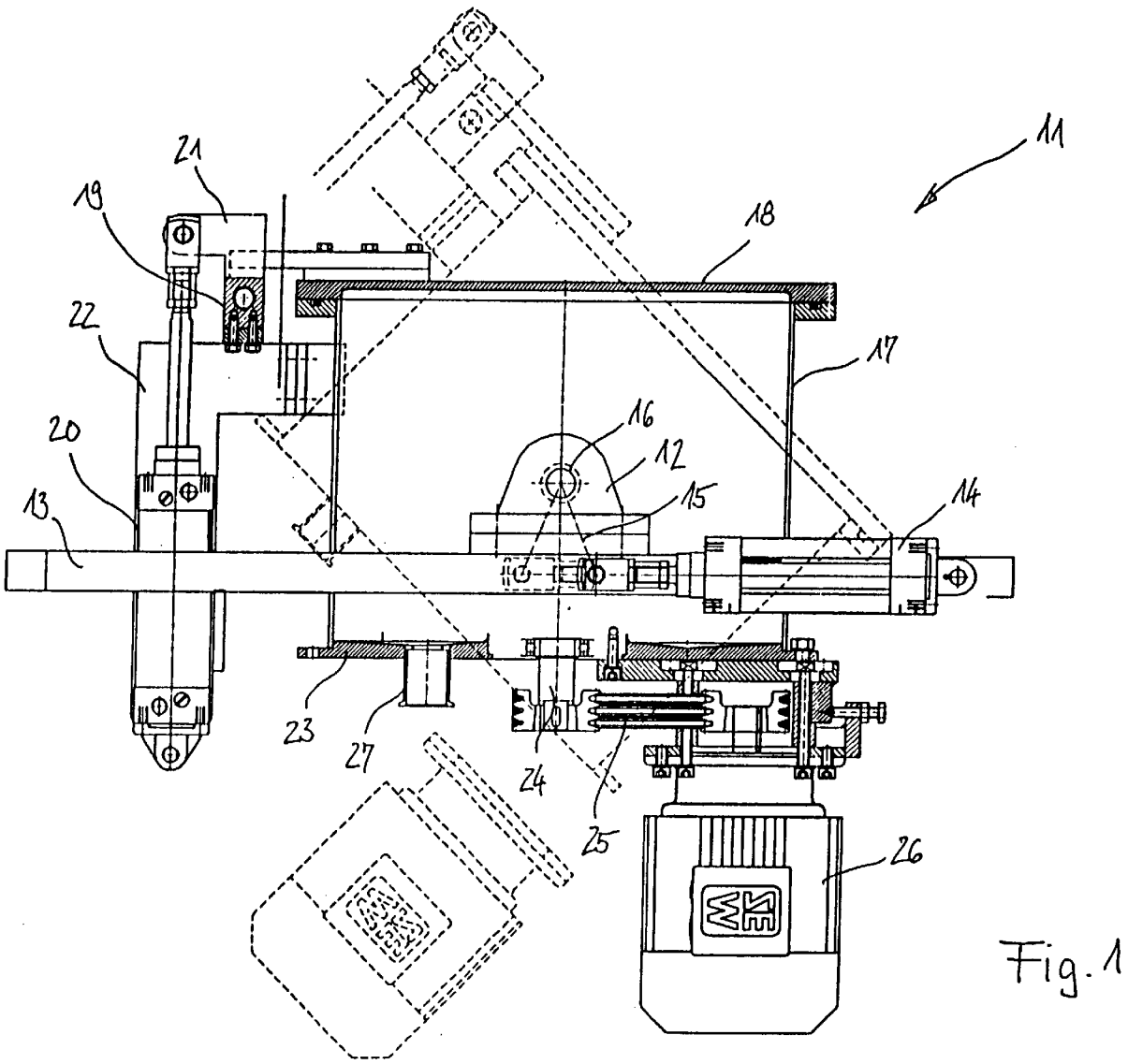
FIG. 1 is a vertical section through an inventive machine in a horizontal axis position, without any details concerning the drum.

FIG. 1, in a vertical section, shows a machine 11 which, by means of pedestal bearings 12, pivotably rests on a machine frame 13. The rotary journals 16 of the pedestal bearings 12 are inserted into the outside of a cylindrical container 17 of the machine. A horizontally positioned setting cylinder 14, via a lever 15 indicated only by its central axis, acts on one of the rotary journals 16. The lever 15 serves to adjust the machine between its positions with a vertical axis shown in continuous lines and with an inclined axis shown in dashed lines.

The container 17 can be closed, to be airtight, by a cover 18. The cover 18 is pivotably supported in a pedestal bearing 19. The cover 18 is acted upon by a setting cylinder 20 via a lever 21. The lever 21 is pivotable together with the cover 18. Both the setting cylinder 20 and the pedestal bearing 19 for the cover 18 are supported on a carrier 22. The carrier 22 is firmly attached to the container 17.

A drive axle 24 projects from the base 23 of the container 17. The axle drive 24, via a belt drive 25, is driven by a driving motor 26. The motor 26 is flanged to the base 23. A discharge muff 27 is in the base 23. At least one inflow muff leading to the container and one gas discharge muff, not illustrated, are included on the container.

Figure 2:
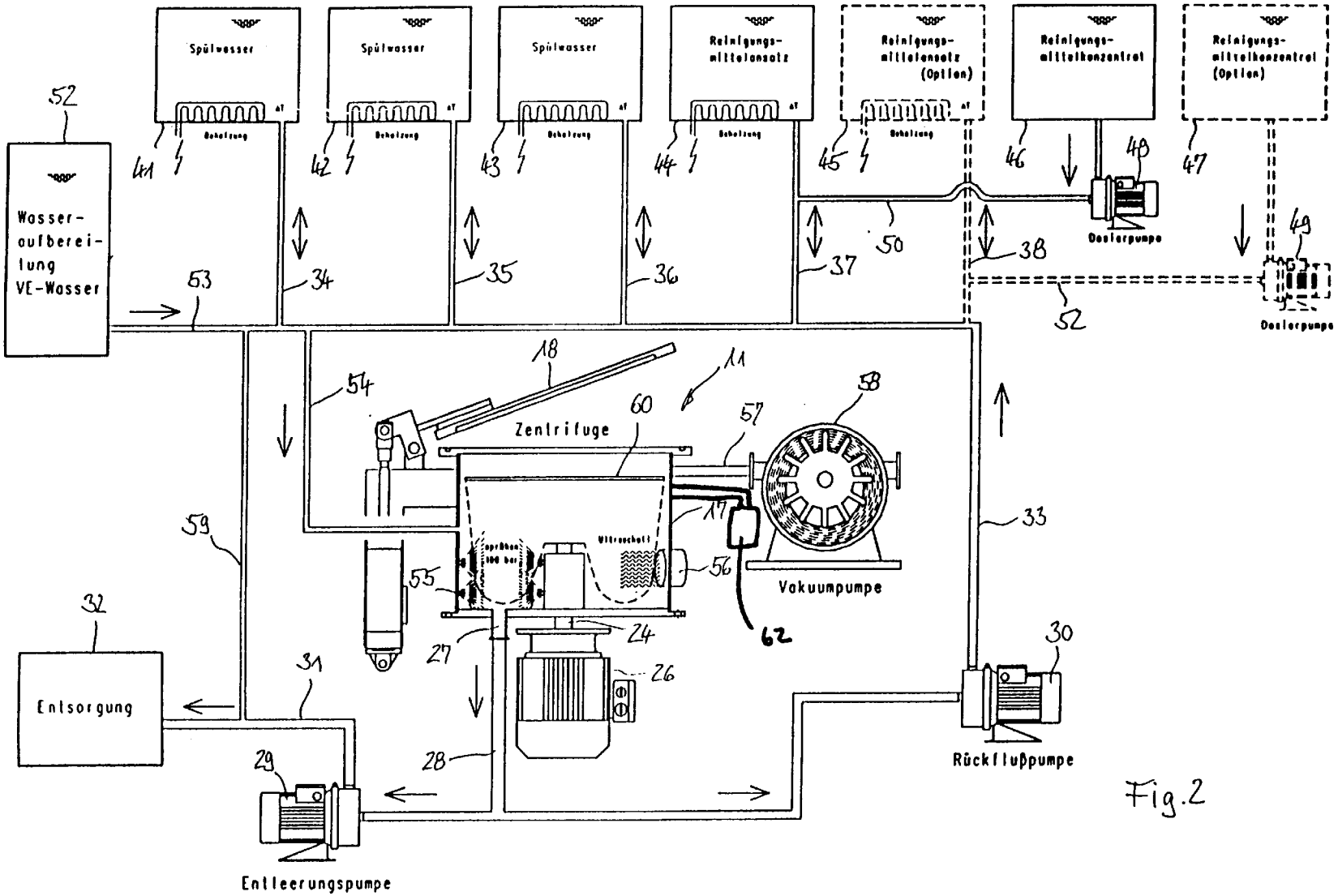
FIG. 2 is a schematic view of the machine according to FIG. 1 integrated into the diagram of the plant, including details regarding the drum.

FIG. 2 shows a schematic of the machine 11 arranged inside a plant. Any details corresponding to those of FIG. 1 have been given the same reference numbers.

FIG. 2 deviates from FIG. 1 in that the driving motor 26 is arranged directly on the driveshaft 24. The details regarding machine pivoting are not illustrated in FIG. 2. The cover 18 is shown in the open position. The discharge muff 27 is connected by a branching discharge line 28 to an emptying pump 29 and a return flow pump 30. An emptying line 31 leads from the emptying pump 29 to a disposal tank 32. A distributor line 33, via individual lines 34 to 38, leads from the return flow pump 30 to three rinsing water tanks 41 to 43 and to two cleaning agent tanks 44, 45. Two cleaning agent concentrate tanks 46, 47 are connected to the individual lines 37, 38 by dispensing pumps 48, 49 and supply lines 50, 51. An inflow line 53 leads from a water processing system 52 into the distributor line 33. A supply line 54 leads into the container 17 from the distributor line 33. The inflow is illustrated only symbolically, with spray nozzles 55 identified inside the container 17.

Furthermore, an ultrasound generator 56 is arranged on the outside of the container. In the upper region, near the cover plane, an extraction muff 57 is provided on the container. The extraction muff 57 is connected to a vacuum pump 58. A shortcircuit line 59 connects the emptying line 31 to the inflow line 53. Inside the container 17 is a drum 60 whose cross-section is substantially ω-shaped and which is preferably releasably connected to the driveshaft 24. Also, a hot air generator 62 may be coupled with the container to dry the parts.

A method of carrying out a process in accordance with the present invention includes filling the drum with small parts. The container is then evacuated by the vacuum pump 58. The evacuation of the container may be in the range of 20 millibars. Thus, even the cavities of the small parts will be evacuated. Accordingly, any defect-causing air pockets will not occur in the cavities when subsequent treatment fluid is introduced into the container. Also, it is possible to set the internal pressure to a higher vacuum level in the range of about 40 millibars. The 40 millibar range ordinarily is just in the excess of the steam pressure of the most volatile components of the treatment fluid. At this pressure, the treatment fluid is prevented from boiling. Thus, this prevents the occurrence of a new source of defects and ensures an effective treatment with a treatment fluid which is free from vapor bubbles.

Next, the drum is positioned into its inclined position. The drum is then rotated in its inclined position for a long period of time at a relatively low speed. The container is ventilated and the drum is moved into the vertical position. Accordingly, at this time, the coated parts could be lifted in the drum from the container.

In a preferred embodiment, the treatment fluid is pumped off. The drum, in its vertical position, is rotated at an increased speed in order to centrifuge the treatment fluid off the parts. This prevents the treatment fluid from being carried over the four subsequent process stages or carried out in the same machine or in a different machine. The treatment process is preferably repeated several times before the drum, with the small parts, is finally removed from the machine. During the subsequent centrifuging operations, hot air can be blown into the container or the container can again be evacuated. This time, it would be evacuated down to an internal pressure which is lower than the steam pressure of the treatment fluid. This enables the small parts to dry as quickly as possible.

To complement the process, it can be preceded by a process stage for washing and/or rinsing the small parts in the same machine. A suitable washing or rinsing liquid is used in each case. First, the container would be evacuated prior to introducing the fluid to eliminate air inclusions and to set the vacuum to a level which is in excess of the steam pressure in order to avoid the formation of vapor bubbles. In the same way that the above treatment process is improved by the above measures, the washing and/or rinsing processes are also improved. Here, the complete moistening of the surfaces of the small parts including their cavities is ensured during the washing or rinsing operation.

While the above detailed description describes the preferred embodiment of the present invention, the invention is susceptible to modification, variation and alteration without deviating from the scope and fair meaning of the subjoined claims.

What is claimed is:

1. A machine for treating small parts with a liquid treatment medium comprising:

a container and a perforated drum arranged in said container, said container adjustable between a vertical axis position and an inclined axis position, said drum being drivable at at least one low speed in the inclined axis position and at at least one higher speed in the vertical axis position;

means for closing the container in an air-tight way;

means for reducing the internal pressure in the container;

means for introducing a liquid treatment medium into the closed and evacuated container;

means for pumping liquid treatment medium out of the container; and means for controlling the internal pressure in the container.

2. A machine according to claim 1, wherein a hot air ventilator being connected to the interior of the container.

3. A machine according to claim 1, wherein an ultrasound generator is coupled with the container.

4. A machine according to claim 1, wherein the perforated drum, in the vertical axis position, can be released from its driving means and removed from the container.

5. A machine according to claim 1, wherein in an axial sectional view, the drum is ω-shaped and provided with a perforated surface.

6. A machine according to claim 1, wherein the container co-axially encloses the drum and that, in particular, it can be adjusted together with the drum from a vertical axis position into an inclined axis position.

* * * * *

UNITED STATES PATENT AND TRADEMARK OFFICE

CERTIFICATE OF CORRECTION

PATENT NO. : 6,484,737 B1
DATED : November 26, 2002
INVENTOR(S) : Alois Muller et al.

It is certified that error appears in the above-identified patent and that said Letters Patent is hereby corrected as shown below:

Title page,
Item [56], References Cited, FOREIGN PATENT DOCUMENTS, add:
-- FR 720,628 2/1931
SE 264,887 11/1947 --

Signed and Sealed this

Thirtieth Day of September, 2003

JAMES E. ROGAN
*Director of the United States Patent and Trademark Office*